US005310108A

United States Patent [19]

Popovich et al.

[11] Patent Number: 5,310,108

[45] Date of Patent: May 10, 1994

[54] HAMMER-STRIKABLE, POWDER-ACTUATED, FASTENER-DRIVING TOOL

[75] Inventors: Michael S. Popovich, Schaumburg; Richard J. Ernst, Palatine; Edward D. Yates, Chicago, all of Ill.

[73] Assignee: Illinois Tool Works Inc., Glenview, Ill.

[21] Appl. No.: 79,293

[22] Filed: Jun. 21, 1993

Related U.S. Application Data

[62] Division of Ser. No. 15,927, Feb. 10, 1993, Pat. No. 5,269,450.

[51] Int. Cl.[5] ..... B25C 1/14

[52] U.S. Cl. ..... 227/10

[58] Field of Search ..... 227/9/10

[56] References Cited

U.S. PATENT DOCUMENTS

| | | | |
|---|---|---|---|
| 3,255,942 | 6/1966 | Bell et al. | 227/10 |
| 3,860,161 | 1/1975 | Eagstrom et al. | 227/10 |
| 4,025,029 | 5/1977 | Kotas et al. | 227/10 |
| 4,252,259 | 2/1981 | Brosius | 227/10 |
| 4,493,376 | 1/1985 | Kopf | 227/10 |
| 4,651,912 | 3/1987 | Hawkins | 227/10 |
| 4,655,380 | 4/1987 | Haytayan | 227/10 |
| 4,830,252 | 5/1989 | Gottlieb et al. | 227/10 |

*Primary Examiner*—Scott Smith

*Attorney, Agent, or Firm*—Schwartz & Weinrieb

[57] ABSTRACT

In a hammer-strikable, powder-actuated, fastener-driving tool, a breech block is mounted within a generally tubular body by several resilient shock absorber structures, each including an elastomeric grommet, an eyelet having a tubular portion surrounded by the grommet and an annular portion, a washer interposed between the annular portion and one end of the grommet, and a screw attaching the breech block to the body. The screw shank extends through the grommet. The screw head bears against the washer. The breech block mounts a firing pin, which is biased backwardly to a normal position, and to which a hammer-strikable button is connected. A barrel mounted to the body so as to be axially movable with respect thereto has an elongate slot. A stud mounted upon the body extends through the slot. A washer disposed around the stud is biased against the barrel so as to impart frictional drag to the barrel.

23 Claims, 3 Drawing Sheets

HAMMER-STRIKABLE, POWDER-ACTUATED, FASTENER-DRIVING TOOL

This application is a division of application Ser. No. 08/015,927, filed Feb. 10, 1993, now U.S. Pat. No. 5,269,450.

TECHNICAL FIELD OF THE INVENTION

This invention pertains to improvements in a hammer-strikable, powder-actuated, fastener-driving tool. A first improvement provides a shock absorber structure mounting a breech block within a generally tubular body. A second improvement provides an annular washer biased to impart frictional drag on a barrel.

BACKGROUND OF THE INVENTION

Hammer-strikable, powder-actuated, fastener-driving tools are used commonly to drive fasteners, such as drive pins, into concrete, masonry, or steel structures. Such a tool derives its motive power from blank cartridges containing gunpowder.

Such tools are exemplified in Kostas U.S. Pat. No. 4,025,029, Brosius U.S. Pat. No. 4,252,259, Kopf U.S. Pat. No. 4,493,376, Hawkins U.S. Pat. No. 4,651,912, Gottlieb et al. U.S. Pat. No. 4,830,252, and Hawkins U.S. Pat. No. 4,890,778. Such a tool may have a tool body defining a handle, a breech block mounted within the tool body by means of screws received by the tool body, and a firing pin movable within the breech block over a range of firing pin movement. The firing pin is biased so as to be normally disposed in a dormant position at a back extreme of the range and is capable of being impelled to a firing position at a front extreme of the range when the firing pin or a structure connected to the firing pin is struck forcibly with a hammer.

Thus, when the firing pin causes a cartridge loaded into the tool to fire, a fastener is driven forcibly from a muzzle by means of a piston and a driving blade. Also, explosive forces are produced, which impart high stresses on the tool particularly where the tool body receives screws or other fasteners mounting the breach block within the tool body. As described below, this invention deals with such stresses in a novel, advantageous manner.

SUMMARY OF THE INVENTION

A first improvement provided by this invention may be advantageously embodied in a hammer-strikable, powder-actuated, fastener-driving tool comprising a tool body defining a handle, a breech block movably mounted within the tool body, and a firing pin movably mounted within the breech block. The breech block is not fixed within the tool body but is mounted within the tool body, near a back end of the tool body, so as to be axially movable over a relatively short range of breech block movement relative to the tool body. The firing pin is mounted within the breech block so as to be axially movable over a substantially longer range of firing pin movement relative to the breech block. The firing pin is biased so as to be normally disposed in a dormant position at a back extreme of the range of firing pin movement. The firing pin is capable of being impelled to a firing position at a front extreme of the range of firing pin movement when the firing pin or a structure connected to the firing pin, near the back end of the tool body, is struck forcibly as by a hammer.

According to the first improvement, a shock absorber structure is disposed within the tool body to absorb high stresses imparted between the breech block and the tool body when a cartridge loaded into the tool is fired by the firing pin. As will be described in detail, the stresses are absorbed through resilient means permitting the breech block to move rearwardly a short distance relative to the tool body when the tool is fired. The resultant reduction in stresses enhances tool life. The shock absorber structure also absorbs recoil when the tool is fired, thus providing more comfort to the user.

A second improvement provided by this invention may be advantageously embodied in a hammer-strikable, powder-actuated, fastener-driving tool comprising such a tubular body, such a breech block, and such a firing pin, along with a barrel or muzzle mounted upon the tool body so as to be axially movable toward and away from the breech block. The barrel has an elongate slot extending axially. Also, a stud is mounted upon the tubular body so as to extend radially into the barrel, through the elongate slot.

According to the second improvement, an annular washer is disposed around the stud so as to bridge the elongate slot. Moreover, the annular washer is biased against the barrel so as to impart frictional drag on the barrel. Thus, although the barrel continues to be axially movable toward and away from the breech block, frictional drag imparted by the annular washer on the barrel retards axial movement of the barrel relative to the tool body.

BRIEF DESCRIPTION OF THE DRAWINGS

These and other objects, features, and advantages of this invention will become evident from the following description of a preferred embodiment of this invention with reference to the accompanying drawings, in which like reference characters designate like or corresponding parts throughout the several views, and wherein.

DETAILED DESCRIPTION OF PREFERRED EMBODIMENT

Figure 1:
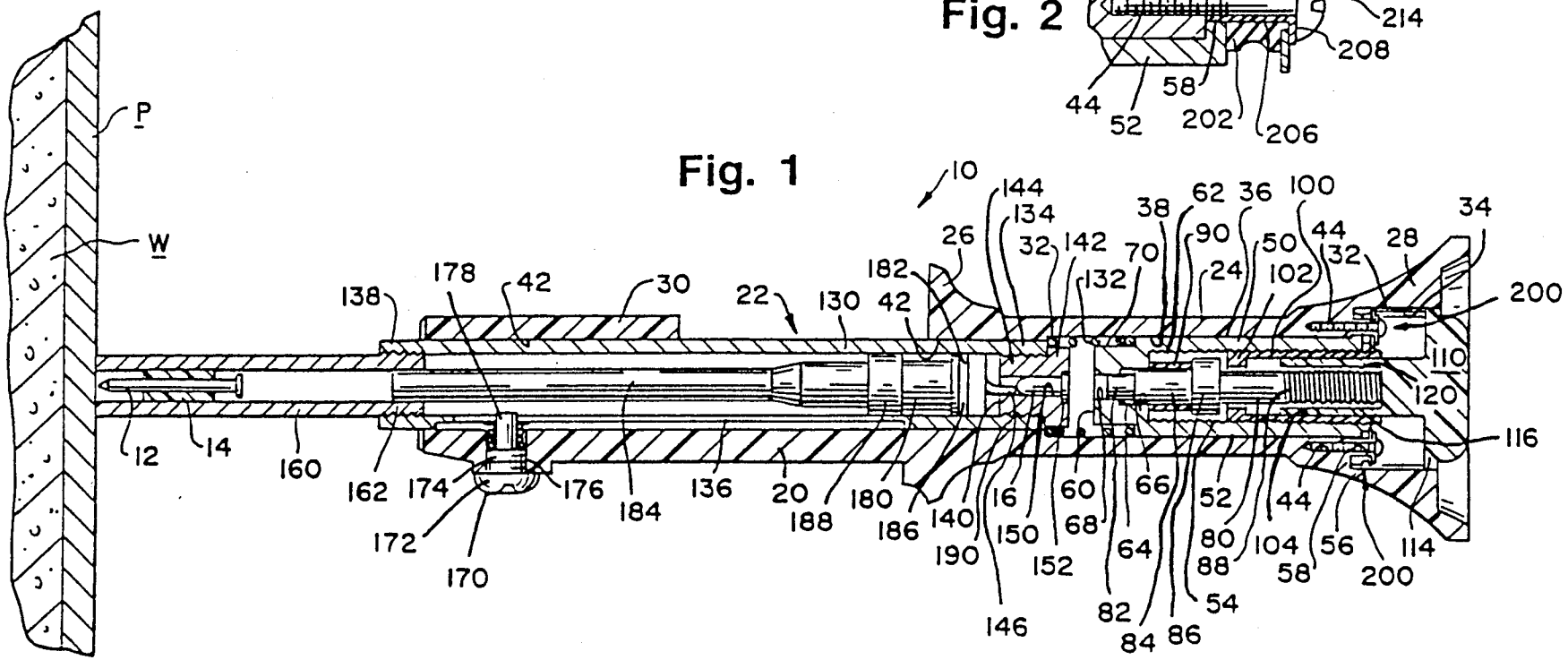
FIG. 1 is a longitudinal, sectional view of a hammer-strikable, powder-actuated, fastener-driving tool embodying the first and second improvements provided by this invention. The tool is shown in an initial stage wherein the tool is about to drive a drive pin through a hole in a metal workpiece, and a concrete wall, before the tubular muzzle is pressed against the metal workpiece with sufficient force to overcome a coiled spring and to move the barrel from an intermediate position to a retracted position.
Figure 3:
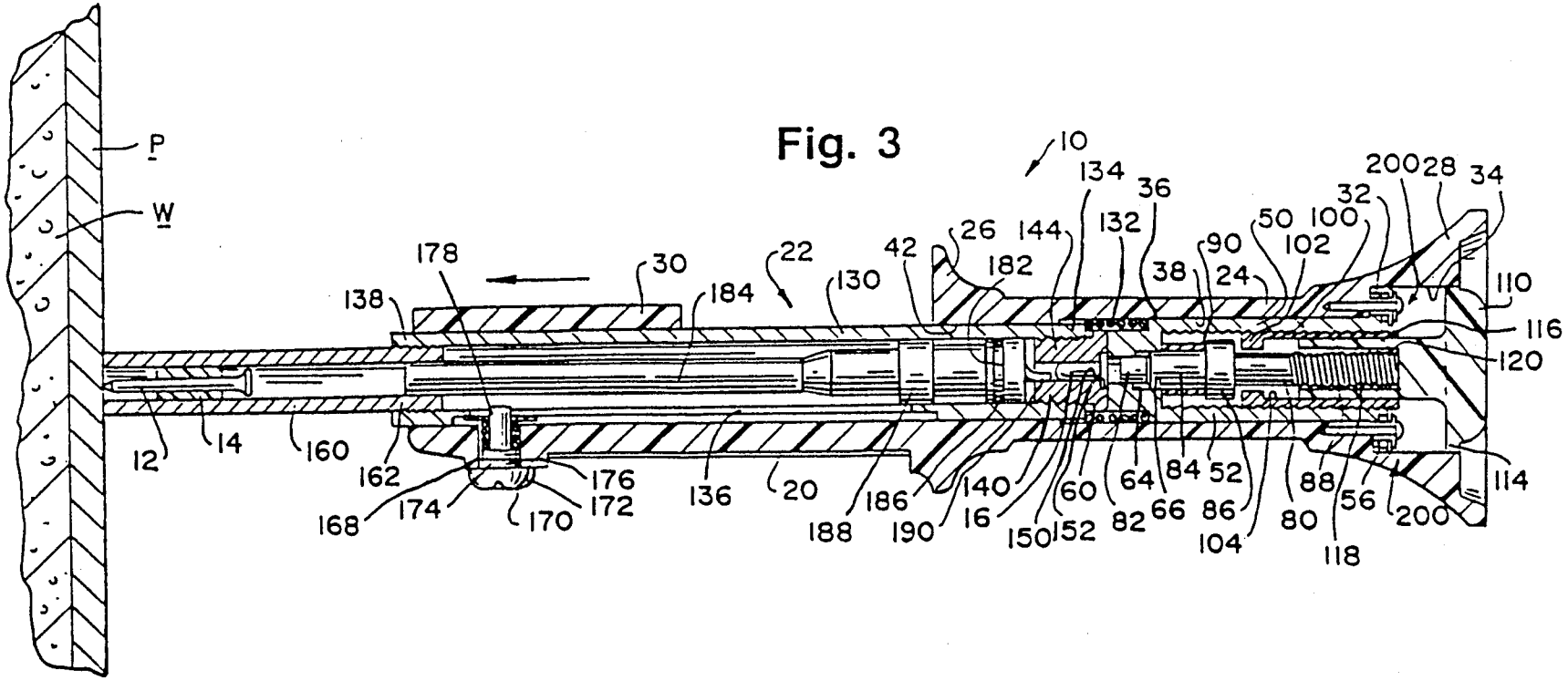
FIG. 3 is a longitudinal, sectional view similar to FIG. 1 but taken to show the tool in a pre-firing stage, after the barrel has been pressed against the metal workpiece with sufficient force to overcome the coiled spring and to move the barrel from the intermediate position to the retracted position.
Figures 4, 5, 6, 7, 8:
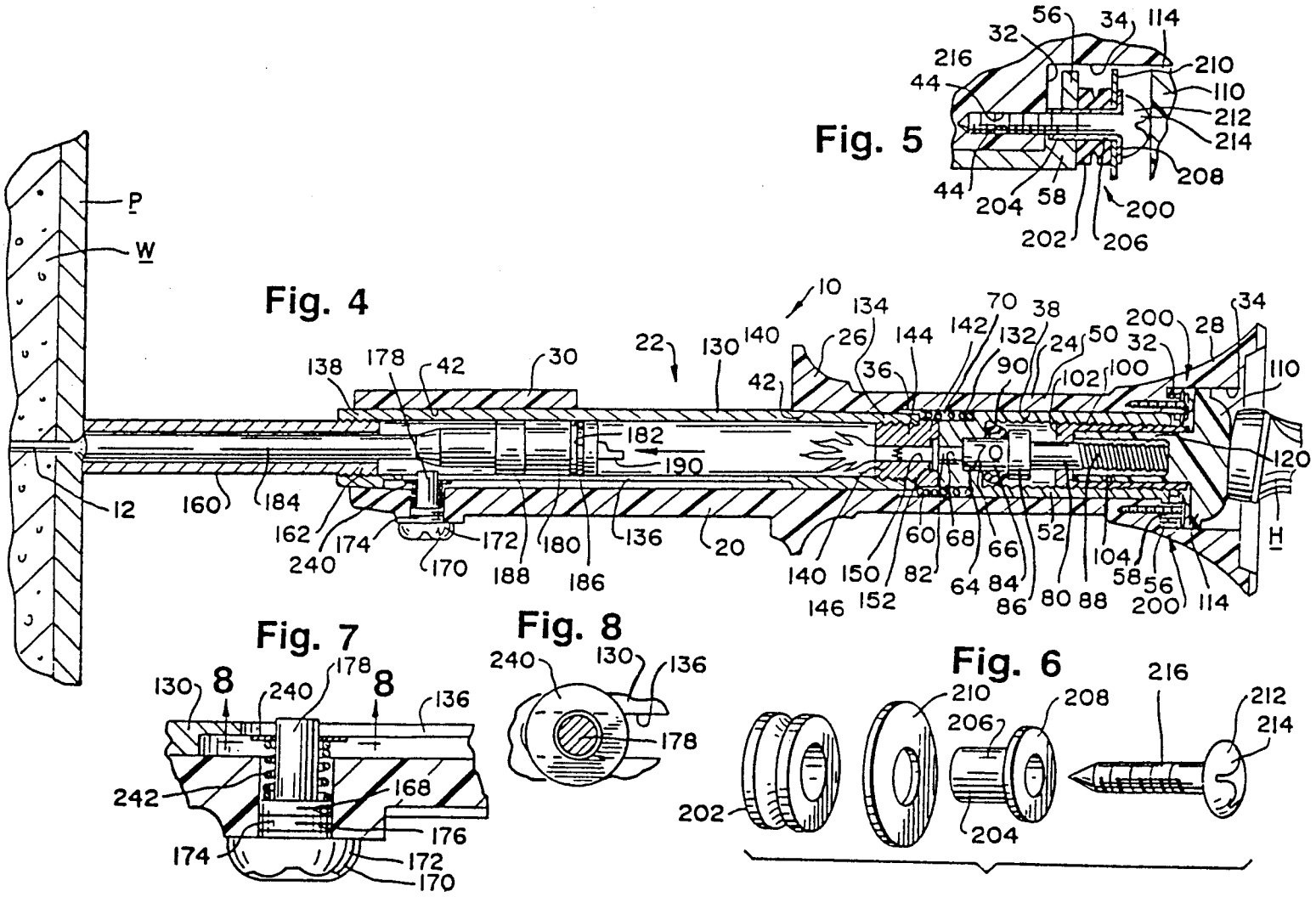
FIG. 4 is a longitudinal, sectional view similar to FIG. 2 but showing the tool in a firing stage, after the button has been struck with a hammer so as to cause the firing pin to fire the cartridge loaded into the tool.
FIG. 5 is an enlarged, fragmentary detail similar to FIG. 2 but showing the shock absorber structure in the firing stage of the tool.
FIG. 6 is a similarly enlarged, exploded, perspective view of the shock absorber structure.
FIG. 7 is an enlarged, fragmentary detail of a stud, an annular washer, and a coiled spring, which are used to impart frictional drag on a barrel of the tool, as shown in FIG. 1.
FIG. 8 is a fragmentary, cross-sectional view taken along line 8—8 of FIG. 7, in a direction indicated by the arrows.

As shown in the drawings, a hammer-strikable, powder-actuated, fastener-driving tool 10 constitutes a preferred embodiment of this invention. The tool 10 derives its motive power from blank cartridges containing gunpowder. A drive pin 12, which is guided by a guidance flute 14, and a blank cartridge 16 are exemplified in FIGS. 1, 3, and 4. Preferably, the drive pin and guidance flute are similar to the drive pin and guidance flute disclosed in Van Allman et al. U.S. Pat. No. 4,979,858, the disclosure of which is incorporated herein by reference. The tool 10 is shown in FIGS. 1, 3, and 4 as used to drive a drive pin 12 through a steel plate P into a concrete wall W. As described in the Van Allman et al. patent noted above, the guidance flute 14 is broken away when the drive pin 12 is driven.

As shown in FIGS. 1, 3, and 4, the tool 10 includes a tool body 20, which is generally tubular, except for a lateral breech 22. The tool body 20 defines a longitudinal axis. The tool body 20 has a back portion 24, which defines a handle flared at its front end 26 and at its back end 28, and a front portion 30, which has the lateral breech 22. The back portion 24 has an annular wall 32 defining the front end of an outer, annular recess 34 of a relatively large diameter, an annular wall 36 defining the front end of a cylindrical cavity 38 of an intermediate diameter, and a cylindrical cavity 42 of a relatively small diameter. The cavity 42 extends from the annular wall 36, through the front portion 26. The lateral breech 22 opens into the cavity 42. The back portion 24 has four threaded sockets 44 (two shown) spaced circumferentially at approximately 90° intervals and opening backwardly at the annular wall 32.

The tool 10 includes a breech block 50, which is mounted within the tool body 20. The breech block 50 is not mounted fixedly therewithin but is mounted therewithin, as described below, so as to be axially movable over a relatively short range of breech block movement relative to the tool body 20.

The breech block 50 has a sleeve portion 52, which is disposed within the cylindrical cavity 38 so as to be axially movable therewithin over the aforenoted range. The sleeve portion 52 has an elongate, threaded socket 54 extending axially and opening backwardly. The breech block 50 has an annular flange 56, which has four similar holes 58 (two shown) spaced circumferentially at approximately 90° intervals. The annular flange 56, which extends radially from the sleeve portion 52, is disposed within the outer recess 34 so as to be axially movable therewithin over the aforenoted range. Near its front end 60, the breech block 50 has an inner, annular recess 64 having a cylindrical wall 66 and a central, cylindrical bore 68, which opens frontwardly from the recess 64, and an outer, annular recess 70.

A firing pin 80 is mounted within the breech block 50 so as to be axially movable over a range of firing pin movement relative to the breech block 50, between a dormant position and a firing position. As compared to the range of breech block movement, the range of firing pin movement is substantially longer. The firing pin 80 is shown in the dormant position in FIG. 1, and also in FIG. 3, and in the firing position in FIG. 4.

The firing pin 80 has a cylindrical tip 82, a cylindrical portion 84 behind the tip 82, a cylindrical boss 86 behind the cylindrical portion 84, and a partially cylindrical, partially threaded portion 88 behind the boss 86. The cylindrical portion 84 mounts a tubular, elastomeric sleeve 90, which is disposed axially between the inner shoulder 62 of the breech block 50 and the cylindrical boss portion 86. In the dormant position of the firing pin 80, the elastomeric sleeve 90 is not compressed axially therebetween, the cylindrical portion 84 extends partially into the recess 64, and the cylindrical tip 82 extends partially into the bore 68. In the firing position of the firing pin 80, the elastomeric sleeve 90 is compressed axially between the breech block shoulder 62 and the firing pin boss 86, as shown in FIG. 4.

An externally threaded, sleeve-like retainer 100 is threaded into the threaded socket 54 of the breech block 50. The retainer 100 has an annular, inwardly extending, front flange 102, which limits backward movement of the firing pin 80 relative to the retainer 100 and to the breech block 50. The retainer 100 has a cylindrical cavity 104 behind the flange 102.

A button 110, which is adapted to be forcibly struck by a hammer H, is connected to the firing pin 80 so as to be conjointly movable with the firing pin 80 relative to the breech block 50. The button 110 has a cylindrical margin 114, which fits movably within the annular recess 34, and a cylindrical stem 116, which has a cylindrical socket 118 opening frontwardly. An internally threaded insert 120 is molded into the cylindrical socket 118 and is threaded onto the partially threaded body portion 88 of the firing pin 80.

A tubular barrel or muzzle 130 is mounted within the cylindrical cavity 42 of the tool body 20 so as to be axially movable between a retracted position relative to the tool body 20 and an advanced position relative thereto. A coiled spring 132 is disposed within the tool body 20, between a back end 134 of the barrel 130 and within the annular recess 70 of the breech block 50, so as to oppose backward movement of the barrel 130 from an intermediate position to the retracted position. The barrel 130 is shown in the intermediate position in FIG. 1 and in the retracted position in FIGS. 3 and 4. The barrel 130 has an alongate, axially extending slot 136, which is diametrically opposite the lateral breech 22 of the tool body 20. Also, the barrel 130 has an internally threaded, front portion 138.

A barrel plug 140, having a hexagonal head 142 which is similar to the hexagonal head of a conventional bolt and a threaded stem 144, is connected to the back end 134 of the barrel 130. The barrel 130 has an internally threaded portion 146, which extends to its back end 134, and into which the threaded stem 144 is threaded. The barrel plug 140 has a cylindrical bore 150 and an annular recess 152 opening backwardly to accommodate a blank cartridge 16. It is possible to unload a spent cartridge 16 and to load a fresh cartridge 16 into the bore 150 and the recess 152, through the lateral breech 22 of the tool body 20, when the barrel 130 is moved sufficiently toward the advanced position. A tubular muzzle 160, which has an externally threaded portion 162 threaded into the internally threaded portion 138 of the barrel 130, extends axially and frontwardly from the barrel 130.

The tool body 20 has a threaded socket 168, near the threaded portion 138. A stud 170, which is mounted to the tool body 20, has a head 172 bearing against the tool body 20 and a shank 174. The shank 174 has a threaded portion 176, which is threaded into the threaded socket 168, and an unthreaded portion 178, which extends radially into the barrel 130, through the elongate slot 136. As shown in FIG. 7 and in other views, the threaded portion 176 has a relatively large diameter, and the unthreaded portion 178 has a relatively small diameter.

A piston 180, having an annular groove 182, and a driving blade 184, extending forwardly from the piston 180, are made in one piece and are mounted in the barrel 130 with an O-ring 186 seated in the groove 182. The O-ring 186 retains the piston 180 and the driving blade 184 frictionally in the barrel 130 but permits the piston 180 and the driving blade 184 to be axially moved within the barrel 130. The piece comprising the piston 180 and the driving blade 184 also has a cylindrical boss 188 near the piston 180. The unthreaded portion 178 of the shank 174 of the stud 170 is adapted to return the piston 180 back to the pre-firing position when the barrel 130 is moved axially forward. Also, the piston 180 has a probe 190, which extends backwardly. The probe 190 is adapted to eject a spent cartridge 16 partially from the bore 150 and the recess 152 of the barrel plug 140, when the barrel 130 is moved to the advanced position while the boss 188 engages the unthreaded portion 178 of the shank 174, so as to cause the piston 180 to be axially moved against the barrel plug 140 and the probe 190 to enter the bore 150.

In accordance with an important feature of this invention, the tool 10 includes a shock absorber structure comprising a plurality of shock absorber structures 200 (two shown) circumferentially spaced at 90° intervals.

Figure 2:
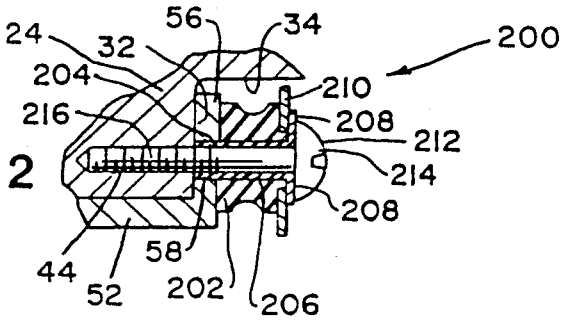
FIG. 2 is an enlarged, fragmentary detail of the shock absorber structure of the tool, as shown FIG. 1. The shock absorber structure is shown in the initial stage of the tool, before a button connected to a firing pin of the tool is struck forcibly by a hammer so as to cause the firing pin to fire a cartridge loaded into the tool.

As shown in FIGS. 2 and 5, each resilient structure 200 comprises an elastomeric grommet 202, an eyelet 204 having a tubular portion 206 and an annular portion 208, an annular washer 210, and a screw 212 having a head 214 and a threaded shank 216.

The tubular portion 206 of the eyelet 204 extends through an associated one of the holes 58 in the annular flange 56 of the breech block 50, against the annular wall 32 of the tool body 20, and engages the margin of an associated one of the threaded sockets 44 of the tool body 20. The elastomeric grommet 202 is disposed around the tubular portion 206 of the eyelet 204, between the annular portion 208 thereof and the annular flange 56. The annular washer 210 is disposed concentrically against the annular portion 208 of the eyelet 204. The screw 212 is mounted so that the shank 216 of the screw 212 is threaded into the associated socket 44, thereby through the elastomeric grommet 202 and the associated hole 58, and so that the head 214 of the screw 212 bears against the annular washer 210.

In each shock absorber structure 200, because the elastomeric grommet 202 is interposed between the head 214 of the screw 212 and the annular flange 56 of the breech block 50, such resilient structure 200 is arranged to resist backward movement of the breech block within the range of breech block movement when the tool 10 is fired. This action absorbs stresses imparted between the breech block 50 and the tool body 20 when a cartridge 16 loaded into the barrel plug 140 is fired by the firing pin 80. Thus, tool life is enhanced, and recoil imposed on the hand of the user is reduced.

As shown in FIGS. 7 and 8, an annular washer 240 is disposed around the unthreaded portion 178 of the stud 170 so as to bridge the elongate slot 136. A coiled spring 242 is disposed around the unthreaded portion 178 of the stud 170, between the threaded portion 176 thereof and the annular washer 240, so as to bias the annular washer 240 against the barrel 130. Because the annular washer 240 is biased against the barrel 130, the annular washer 240 imparts frictional drag on the barrel 130. Thus, although the barrel 130 continues to be axially movable toward and away from the breech block 50, frictional drag imparted by the annular washer 240 on the barrel 130 retards axial movement of the barrel 130 relative to the tool body 20.

Various modifications may be made in the preferred embodiment described above without departing from the scope and spirit of this invention. It is therefore to be understood that within the scope of the appended claims, the present invention may be practiced otherwise than as specifically described herein.

We claim:

1. A powder-actuated, fastener-driving tool, comprising:

a substantially tubular body defining a longitudinal axis;

a breech block mounted within a rear end portion of said substantially tubular body;

a barrel mounted within a front end portion of said substantially tubular body so as to be axially movable toward and away from said breech block, said barrel having an axially extending slot defined therein;

a fastener, to be driven into a substrate, disposed within a forward portion of said barrel;

driving means disposed within said barrel at a position rearwardly of said fastener for driving said fastener into said substrate;

charge means, disposed within a rear end portion of said barrel, for propelling said driving means, which will in turn, drive said fastener-to-be-driven into said substrate when said charge means is fired;

a firing pin mounted within said breech block so as to be axially movable between a dormant position, and a firing position at which said firing pin fires said charge means so as to cause said driving means to move within said barrel and thereby, in turn, cause said fastener to be driven into said substrate; and means mounted within said substantially tubular body and engaging said barrel for imparting frictional drag upon said barrel as said barrel moves relative to said substantially tubular body when moving toward and away from said breech block, said frictional drag imparting means comprising a stud mounted upon said tubular body and extending radially inwardly such that a radially inner shank portion of said stud is disposed within said axially extending slot of said barrel, and an annular washer, disposed about said radially inner shank portion of said stud so as to bridge said axially extending slot of said barrel, is biased against said barrel so as to impart said frictional drag thereto.

2. A tool as set forth in claim 1, wherein:

said tubular body comprises a radially extending threaded socket;

said stud further comprises a radially outer threaded portion threadedly engaged within said threaded socket of said tubular body; and a spring means is interposed between said threaded portion of said stud and said annular washer for biasing said annular washer into engagement with said barrel.

3. A tool as set forth in claim 1, further comprising:

biasing means interposed between said barrel and said breech block for normally biasing said barrel away from said breech block.

4. A tool as set forth in claim 3, wherein:

said biasing means comprises a coil spring coaxially disposed with respect to said barrel and said breech block.

5. A tool as set forth in claim 1, further comprising:

biasing means disposed within said breech block and engaged with said firing pin for biasing said firing pin to said dormant position.

6. A tool as set forth in claim 5, wherein:

said biasing means comprises an elastomeric sleeve disposed about said firing pin.

7. A tool as set forth in claim 1, wherein:

said driving means comprises a piston disposed forwardly of said charge means for receiving the propulsive force of said charge means when said charge means is fired by said firing pin, and a driving blade integrally connected to said piston and extending axially forwardly of said piston for drivingly engaging said fastener to be driven into said substrate.

8. A hammer-strikable, powder-actuated, fastener-driving tool adapted to be fired so as to drive a fastener from said tool into a substrate, comprising:

a substantially tubular body defining a longitudinal axis;

a breech block mounted within a rear end portion of said substantially tubular body;

a barrel mounted within a front end portion of said substantially tubular body so as to be axially movable toward and away from said breech block, said barrel housing a fastener, to be driven into a substrate, within a forward portion of said barrel, and having an axially extending slot defined therein;

driving means disposed within said barrel at a position rearwardly of said fastener for driving said fastener into said substrate;

charge means, disposed within a rear end portion of said barrel, for propelling said driving means, which will in turn, drive said fastener-to-be-driven into said substrate when said charge means is fired;

a firing pin mounted within said breech block so as to be axially movable in response to a hammer blow between a dormant position, and a firing position at which said firing pin fires said charge means so as to cause said driving means to move within said barrel and thereby, in turn, cause said fastener to be driven into said substrate;

rearwardly open recess means defined within said rear end portion of said substantially tubular body so as to be disposed rearwardly of said breech block;

means, movably disposed within said rearwardly open recess means between an inoperative dormant position and an operative firing position, engaged with said firing pin, and externally accessible through said rearwardly open recess means, for receiving a hammer blow and thereby transmitting the force of said hammer blow to said firing pin for firing said charge means and causing said fastener to be driven from said barrel by said driving means when said hammer blow causes movement of said means from said inoperative dormant position to said operative firing position; and means mounted within said substantially tubular body and engaging said barrel for imparting frictional drag upon said barrel as said barrel moves relative to said substantially tubular body when moving toward and away from said breech block, said frictional drag imparting means comprising a stud mounted upon said tubular body and extending radially inwardly such that a radially inner shank portion of said stud is disposed within said axially extending slot of said barrel, and an annular washer, disposed about said radially inner shank portion of said stud so as to bridge said axially extending slot of said barrel, is biased against said barrel so as to impart said frictional drag thereto.

9. A tool as set forth in claim 8, wherein:

said tubular body comprises a radially extending threaded socket;

said stud further comprises a radially outer threaded portion threadedly engaged within said threaded socket of said tubular body; and a spring means is interposed between said threaded portion of said stud and said annular washer so as to bias said annular washer into engagement with said barrel.

10. A tool as set forth in claim 8, wherein:

a rear portion of said firing pin is externally threaded; and said means movably disposed within said rearwardly open recess means for receiving said hammer blow comprises a button which is internally threaded for threadedly engaging said externally threaded rear portion of said firing pin.

11. A tool as set forth in claim 8, further comprising:

biasing means interposed between said barrel and said breech block for normally biasing said barrel away from said breech block.

12. A tool as set forth in claim 11, wherein:

said biasing means comprises a coil spring coaxially disposed with respect to said barrel and said breech block.

13. A tool as set forth in claim 8, further comprising:

biasing means disposed within said breech block and engaged with said firing pin for biasing said firing pin toward said dormant position.

14. A tool as set forth in claim 13, wherein:

said biasing means comprises an elastomeric sleeve disposed about said firing pin.

15. A tool as set forth in claim 8, wherein:

said driving means comprises a piston disposed forwardly of said charge means for receiving the propulsive force of said charge means when said charge means is fired by said firing pin, and a driving blade integrally connected to said piston and extending axially forwardly of said piston for drivingly engaging said fastener to be driven into said substrate.

16. A hammer-strikable, powder-actuated, fastener-driving tool adapted to be fired so as to drive a fastener from said tool into a substrate, comprising:

a substantially tubular body defining a longitudinal axis;

a handle defined upon a first rear end section of said substantially tubular body;

a breech block mounted within a rear end portion of said substantially tubular body;

a barrel mounted within a second front end section of said substantially tubular body so as to be axially movable toward and away from said breech block, said barrel housing a fastener, to be driven into a substrate, within a forward end portion of said barrel, and having an axially extending slot defined therein;

driving means disposed within said barrel at a position rearwardly of said fastener for driving said fastener into said substrate;

charge means, disposed within said rear end portion of said barrel at a position forwardly of said breech block, for propelling said driving means, which will in turn, drive said fastener-to-be-driven into said substrate when said charge means is fired;

a firing pin mounted within said breech block so as to be axially movable in response to a hammer blow between a dormant position, and a firing position at which said firing pin fires said charge means so as to cause said driving means to move within said barrel and thereby, in turn, cause said fastener to be driven into said substrate;

rearwardly open recess means defined within said rear end portion of said substantially tubular body so as to be disposed rearwardly of said breech block;

means, movably disposed within said rearwardly open recess means between an inoperative dormant position and an operative firing position, engaged with said firing pin, and externally accessible through said rearwardly open recess means, for receiving a hammer blow and thereby transmitting the force of said hammer blow to said firing pin for firing said charge means and causing said fastener to be driven from said barrel by said driving means when said hammer blow causes movement of said means from said inoperative dormant position to said operative firing position; and means mounted within said substantially tubular body and engaging said barrel for imparting frictional drag upon said barrel as said barrel moves relative to said substantially tubular body when moving toward and away from said breech block, said frictional drag imparting means comprising a stud mounted upon said tubular body and extending radially inwardly such that a radially inner shank portion of said stud is disposed within said axially extending slot of said barrel, and an annular washer, disposed about said radially inner shank portion of said stud so as to bridge said axially extending slot of said barrel, is biased against said barrel so as to impart said frictional drag thereto.

17. A tool as set forth in claim 16, wherein:

said tubular body comprises a radially extending threaded socket;

said stud further comprises a radially outer threaded portion threadedly engaged within said threaded socket of said tubular body; and a spring means is interposed between said threaded portion of said stud and said annular washer so as to bias said annular washer into engagement with said barrel.

18. A tool as set forth in claim 16, wherein:

a rear portion of said firing pin is externally threaded; and said means movably disposed within said rearwardly open recess means for receiving said hammer blow comprises a button which is internally threaded for threadedly engaging said externally threaded rear portion of said firing pin.

19. A tool as set forth in claim 16, further comprising:

biasing means interposed between said barrel and said breech block for normally biasing said barrel away from said breech block.

20. A tool as set forth in claim 19, wherein:

said biasing means comprises a coil spring coaxially disposed with respect to said barrel and said breech block.

21. A tool as set forth in claim 16, further comprising:

biasing means disposed within said breech block and engaged with said firing pin for biasing said firing pin toward said dormant position.

22. A tool as set forth in claim 21, wherein:

said biasing means comprises an elastomeric sleeve disposed about said firing pin.

23. A tool as set forth in claim 16, wherein:

said driving means comprises a piston disposed forwardly of said charge means for receiving the propulsive force of said charge means when said charge means is fired by said firing pin, and a driving blade integrally connected to said piston and extending axially forwardly of said piston for drivingly engaging said fastener to be driven into said substrate.

* * * * *